US007793495B2

(12) United States Patent
Bradley et al.

(10) Patent No.: US 7,793,495 B2
(45) Date of Patent: Sep. 14, 2010

(54) ENGINE GAS TEMPERATURE REDUCTION

(75) Inventors: James C. Bradley, New Haven, IN (US); Anthony J. Cook, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 728 days.

(21) Appl. No.: 11/750,581

(22) Filed: May 18, 2007

(65) Prior Publication Data

US 2008/0282688 A1 Nov. 20, 2008

(51) Int. Cl.
*F01N 1/00* (2006.01)

(52) U.S. Cl. ..... 60/324; 60/287; 60/289; 60/292; 60/293; 60/320

(58) Field of Classification Search ..... 60/274, 60/287, 289, 291, 292, 293, 298, 311, 320, 60/324

See application file for complete search history.

(56) References Cited

U.S. PATENT DOCUMENTS 1,025,251 A 5/1912 Desmond
3,475,905 A * 11/1969 Wilford ..... 60/287
3,577,728 A * 5/1971 Von Brimer et al. ..... 60/283
4,265,332 A 5/1981 Presnall et al.
4,706,454 A * 11/1987 Smith, Jr. ..... 60/274
4,926,633 A * 5/1990 Nash et al. ..... 60/226.1
5,279,117 A * 1/1994 Kaiser ..... 60/292
6,951,099 B2 * 10/2005 Dickau ..... 60/300
7,178,859 B2 2/2007 Browne et al.
7,275,367 B2 * 10/2007 Tamura et al. ..... 60/324
2007/0033927 A1 2/2007 Homby et al.

* cited by examiner

*Primary Examiner*—Binh Q Tran
(74) *Attorney, Agent, or Firm*—Jeffrey P. Calfa; Mark C. Bach

(57) ABSTRACT

An exhaust system for a motor vehicle engine includes mixing vent flaps in the exhaust pipe which open responsive to exhaust temperature. The vent flap forms a portion of the exhaust pipe when closed and is pivotally attached along one edge to the exhaust pipe to open inwardly into the exhaust pipe to constrict and accelerate flow in the pipe to allow outside air to be drawn into the exhaust pipe. A magnetic catch latches the vent flap in its closed position and a magnetic release responsive to increased temperature of the exhaust stream releases the vent flap.

8 Claims, 3 Drawing Sheets

ENGINE GAS TEMPERATURE REDUCTION

BACKGROUND OF THE INVENTION

1. Technical Field

The present invention relates generally to exhaust systems and more particularly to a system for mixing ambient air with exhaust air to reduce exhaust gas temperature.

2. Description of the Problem

Elevated exhaust gas temperatures from the tail pipes of diesel engine equipped motor vehicles have become a greater problem with the introduction of diesel particulate trap/filters (DPF) and the need for regeneration of these filters. Diesel particulate filters remove from the exhaust flow of diesel engines unburned and partially burned hydrocarbons (a major part of the particulate matter produced by diesels during combustion). A DPF may be periodically regenerated by raising the temperature in the filter sufficiently to oxidize the particulate matter. Doing so increases the temperature of the exhaust to a degree that it may harm passers by where the exhaust is discharged near ground level.

Exhaust system cooling using a venturi in the exhaust to draw in cooling air through vents is known from U.S. Pat. No. 4,265,332. In the '332 patent a sleeve (cylindrical heat shield) with an open upstream end was placed around a portion of an exhaust pipe including the muffler. The portion of the exhaust pipe extending from the muffler terminated in constricted nozzle. The sleeve extended past the constricted nozzle/venturi to become, in effect, an extension of the exhaust pipe. The venturi accelerated the exhaust drawing cooling air in through the open end of the sleeve upstream of the muffler, around the exhaust pipe and eventually into the exhaust stream. Though this is done to cool the exhaust system, particularly the muffler, the air is mixed with the exhaust before final discharge to atmosphere. The venturi and sleeve were fixed elements of the exhaust system assembly.

SUMMARY OF THE INVENTION

The invention provides a plurality of louvers or valves that are located strategically along the exhaust pipe downstream from the diesel particulate trap and which open in response to the exhaust gas reaching an elevated temperature. The valves are hinged at their upstream ends along the exhaust pipe and open into the exhaust pipe to create a venturi effect drawing outside air into the pipe which mixes with the exhaust stream reducing its temperature. Positioning of the valves is controlled by magnetic attraction or repulsion between a portion of the valve and a anchor magnet placed in or near the pipe. The magnetic field between the valve and the anchor is subject to interruption when a magnetic material positioned intervening to the valve magnet and the anchor magnet is raised above its curie temperature rendering the material para-magnetic and allowing the intervening layer to interrupt the magnetic field and the like poles facing one another to repel the vents back to a closed position.

Advantageously, no control intervention is required to implement this system. The system is completely passive.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
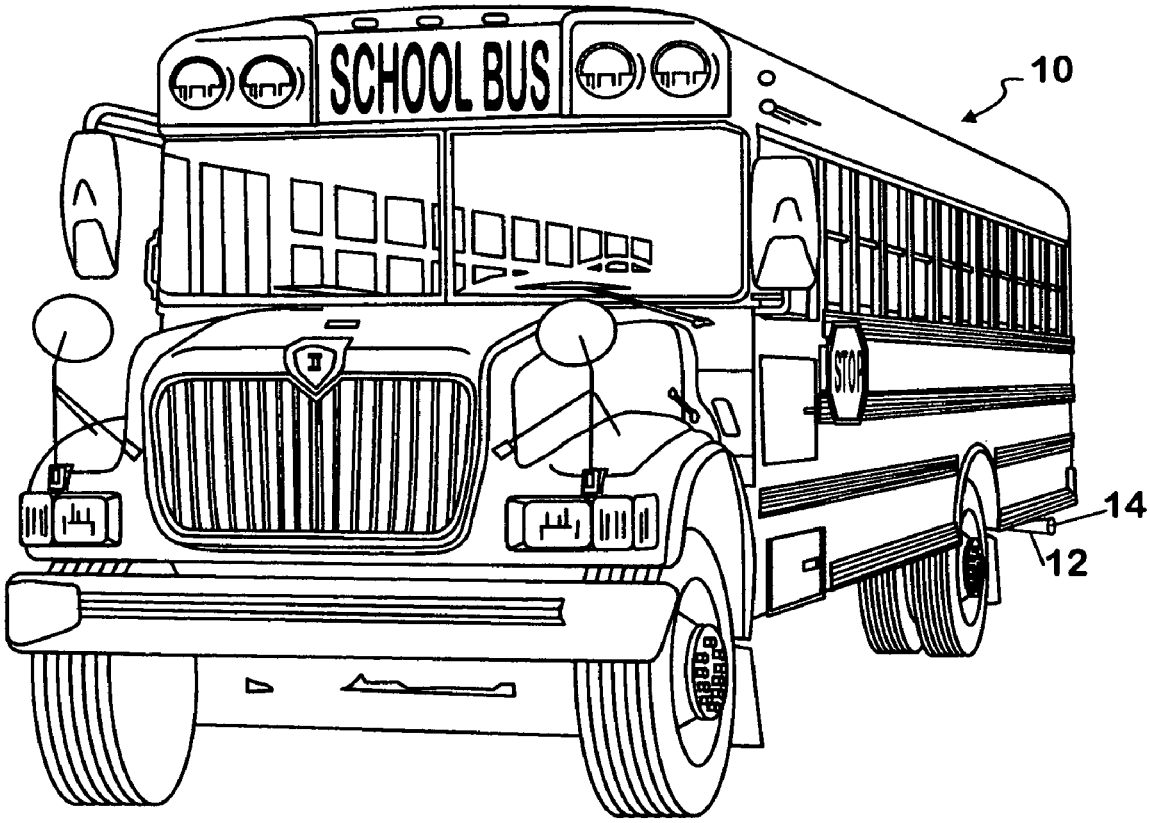
FIG. 1 is a perspective view of a school bus which is representative of one type of vehicle which may be modified to incorporate the present invention.

Referring to the drawings and in particular referring to FIG. 1 a vehicle such as a school bus 10 which is typically equipped with a diesel engine requiring use of a diesel particulate filter (DPF) is shown. In a vehicle such as school bus 10 the tail pipe of an exhaust system typically runs under the vehicle to a point of discharge 14 from a tail pipe extension 12 along the side or back of the vehicle. The point of discharge 14 is at a level where passers-by can be directly exposed to the exhaust flow from the tail pipe extension 12.

Figure 2:
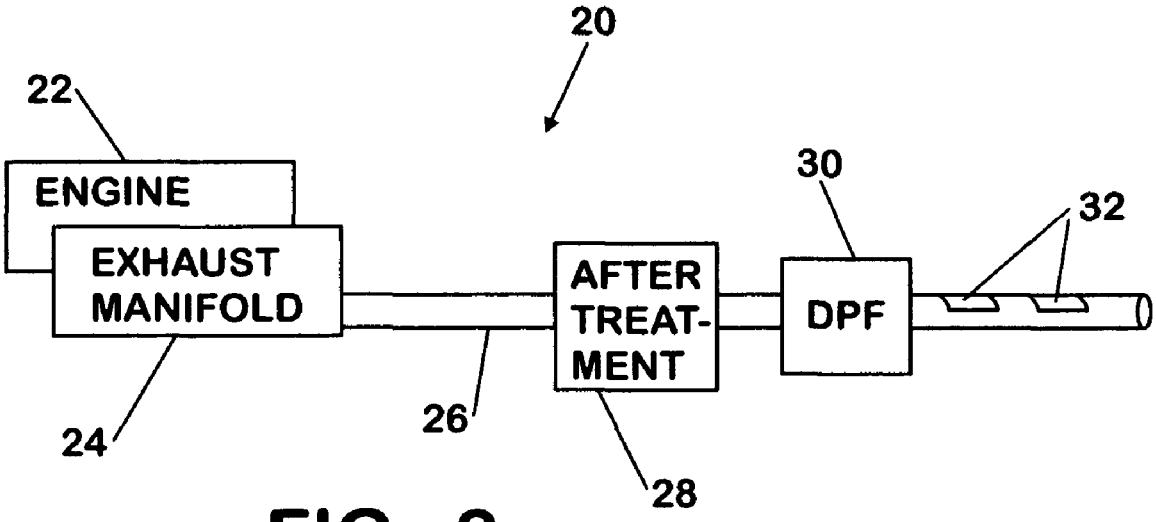
FIG. 2 is a schematic of an exhaust system.

FIG. 2 is a simplified exhaust system 20 from a diesel engine 22 such as may be installed on bus 10. An exhaust manifold 24 collects exhaust gas from engine 22 and a pipe 26 carries the gas to an aftertreatment unit 28 and a diesel particulate filter 30. DPF 30 is subject to periodic regeneration which conventionally provides for raising the temperature of the exhaust stream into the DPF 30, or introducing fuel to the exhaust stream, resulting in oxidation occurring in DPF 30. Either type of regeneration results in much higher exhaust gas temperatures in the exhaust stream in the portion of pipe 26 which extends downstream from DPF 30. The portion of pipe 26 extending downstream from DPF 30 includes two vent flaps 32, which angle inwardly when open into pipe 26 to admit outside air to the tail pipe. Vent flaps 32 open when exhaust temperature reaches a preselected critical level. On opening they constrict the exhaust pipe to create venturi nozzles in tail pipe 26, which accelerate the exhaust flow, reducing pressure in the pipe downstream in the tail pipe from the nozzle and drawing outside air in to mix with and cool the exhaust stream.

Figure 3:
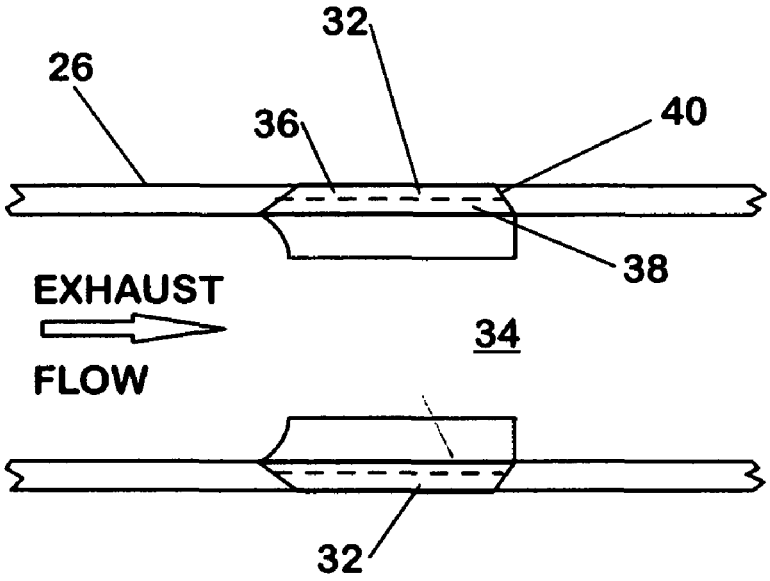
FIG. 3 is a cross sectional view of a portion of an exhaust pipe incorporating a first embodiment of the invention.

FIG. 3 illustrates a first embodiment of the invention in which two vent flaps 32 are located opposed to one another in the wall of exhaust pipe 26. The vent flaps occupy spaces 40 in the pipe and when moved leave openings through which air can pass between pipe 26 and the outside environment. Vent flaps 32 obviously must open in a fashion which supports drawing air into the interior 34 of pipe 26 rather than allowing exhaust to pass outward from the pipe to the environment ahead of the point of discharge 14. Spaces 40 have beveled edges to prevent vent flaps 32 from pivoting or opening outwardly.

Vent flaps 32 comprise two layers 36 and 38. Outer layers 36 are permanent magnets with like polarity poles oriented inwardly so that the opposed flaps repel one another pushing the vent flaps outwardly to closed positions. Inner layers 38 are made of a material exhibiting high magnetic susceptibility at normal exhaust temperatures but which has a Curie point selected so that the layer loses susceptibility at exhaust temperatures associated with regeneration of DPF 30. With loss of magnetic susceptibility magnetic flux is not transmitted through the inner layers 38 of the flaps 32 with an accompanying loss of repulsive force between the two permanent magnet layers 36.

Figure 4:
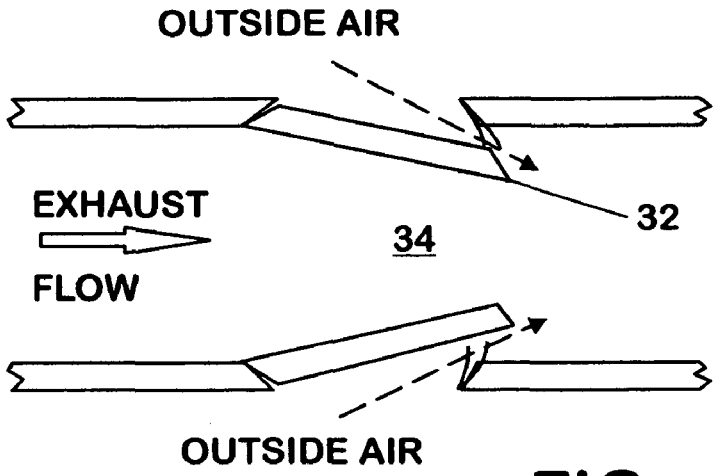
FIG. 4 is a cross sectional view of a portion of an exhaust pipe illustrating operation of the first embodiment of the invention.

The vent flaps 32 are fabricated with material memory which induces them to turn inwardly, pivoting at their respective upstream ends to constrict the interior of the pipe as they open to form the required venturi nozzle. This operation is illustrated in FIG. 4. With the end of regeneration exhaust temperature drops and the magnetic susceptibility of the inner layers 38 will recover, resulting in the vent flaps 32 closing.

Figure 5:
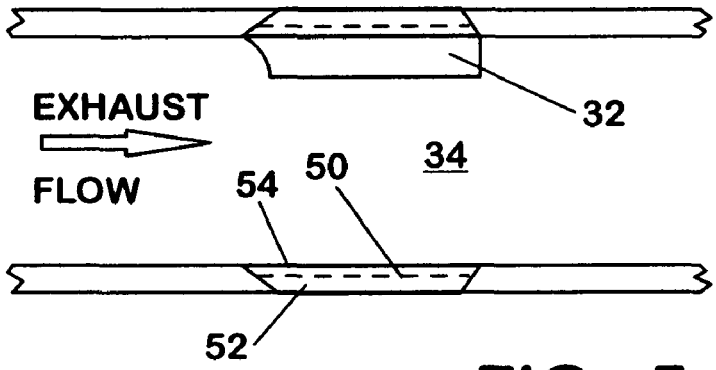
FIG. 5 is a cross sectional view of a portion of an exhaust pipe incorporating a second embodiment of the invention.
Figure 6:
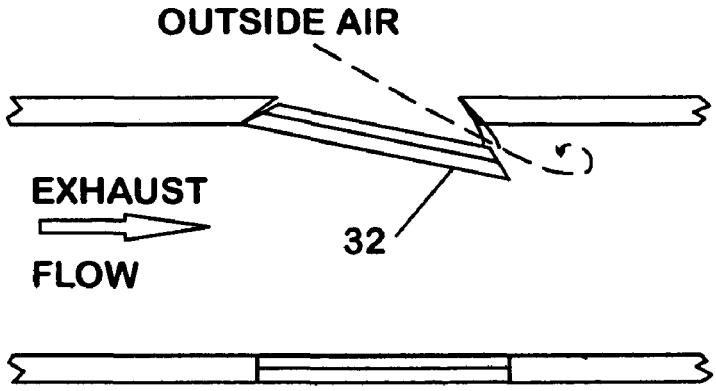
FIG. 6 is a cross sectional view of a portion of an exhaust pipe illustrating operation of the second embodiment of the invention.

FIGS. 5 and 6 illustrate a second embodiment of the invention. Here a single flap 32 is located opposite an anchor region 50 which, like a flap 32, includes inner and outer layers 54 and 52. The inner layer 54 loses magnetic susceptibility at elevated exhaust temperatures while layer 52 is a permanent magnet. While in both embodiments a layer of high magnetic susceptibility material is placed adjacent a permanent magnet layer, it is not strictly necessary to have two such layers. The layers in a vent flap may be made of materials which, with increasing temperature, induce the outer layer to expand more quickly than the inner layer. It is only necessary to have such a layer between the two permanent magnets, whether in contact or not with a magnet layer. In fact, it is possible to sandwich a magnet in layers of high magnetic susceptibility and place the layer in the center of the tail pipe 26. A number of alternative arrangements could be contrived and remain within the spirit of the present invention. In the broadest sense the invention may be viewed as using permanent magnet(s) to operate as catches for the vent flaps and the layer of high magnetic susceptibility, which is sensitive to increased temperature for interrupting magnetic fields which position the vent flaps closed, as a release.

While the invention is shown in only two of its forms, it is not thus limited but is susceptible to various changes and modifications without departing from the spirit and scope of the invention.

What is claimed is:

1. An exhaust system for a motor vehicle engine comprising:

an exhaust pipe;

a vent flap forming a portion of the exhaust pipe when closed, the vent flap being pivotally attached along one edge to the exhaust pipe to open inwardly into the exhaust pipe to constrict and accelerate exhaust gas flow to draw outside air into the exhaust pipe through an opening the exhaust pipe left by movement of the vent flap;

the position of the vent flap being responsive to exhaust gas temperature to open in response to the exhaust gas temperature reaching a preselected critical temperature;

the vent flap including a permanent magnet;

an anchor magnet positioned to repel the permanent magnet of the vent flap to urge the vent flap into a closed position; and a layer of material of high magnetic susceptibility between the anchor magnet and the permanent magnet of the vent flap with a curie point selected to match the preselected critical temperature.

2. An exhaust system for a motor vehicle engine according to claim 1, further comprising:

a magnetic catch for latching the vent flap in a closed position; and a magnetic release responsive to increased temperature of the exhaust stream for releasing the vent flap.

3. An exhaust system for a motor vehicle engine according to claim 1, further comprising:

an opposed pair of vent flaps in the exhaust pipe;

each vent flap of the opposed pair including an outer permanent magnet and an inner layer of high magnetic susceptibility; and the permanent magnets being mutually oriented to repel one another.

4. An exhaust system for a motor vehicle engine according to claim 1, further comprising:

a diesel particulate filter which exhibits substantially elevated operating temperatures during regeneration.

5. An exhaust pipe comprising:

a vent flap incorporated into the exhaust pipe;

a magnetic catch for retaining the vent flap in a closed position;

a magnetic release responsive to an elevated exhaust temperature for releasing the vent flap from its closed position; and the vent flap forming, upon opening, a venturi nozzle in the exhaust pipe.

6. An exhaust pipe according to claim 5, further comprising:

a plurality of vent flaps, disposed in opposing pairs with the magnetic catches and releases being incorporated in the vent flaps as layers.

7. An exhaust pipe according to claim 5, further comprising:

the magnetic catch including first and second magnets disposed to repel one another with the first magnet being incorporated in the vent flap; and the magnetic release including an layer of high magnetic susceptibility intermediate the first and second magnets.

8. An exhaust pipe according to claim 6, further comprising:

a diesel particulate filter upstream in the exhaust pipe from the magnetic release.

* * * * *